US009074441B2

(12) United States Patent
Addison et al.

(10) Patent No.: US 9,074,441 B2
(45) **Date of Patent: *Jul. 7, 2015**

(54) DRILL CUTTINGS METHODS AND SYSTEMS

(75) Inventors: Craig William Addison, Inverurie (GB); Kenneth Richard Carlsson, Perth (AU); Joseph Daniel Farrar, Spring, TX (US); Perry Lyman, Tomball, TX (US)

(73) Assignee: KMC OIL TOOLS B.V., Amsterdam (NL)

( * ) Notice: Subject to any disclaimer, the term of this patent is extended or adjusted under 35 U.S.C. 154(b) by 349 days.

This patent is subject to a terminal disclaimer.

(21) Appl. No.: 13/498,481

(22) PCT Filed: Sep. 25, 2010

(86) PCT No.: PCT/US2010/050315

§ 371 (c)(1),
(2), (4) Date: Mar. 27, 2012

(87) PCT Pub. No.: WO2011/038304

PCT Pub. Date: Mar. 31, 2011

(65) Prior Publication Data

US 2012/0181086 A1 Jul. 19, 2012

Related U.S. Application Data

(60) Provisional application No. 61/246,494, filed on Sep. 28, 2009.

(51) Int. Cl.

| | |
|---|---|
| ***E21B 21/06*** | (2006.01) |
| ***B65D 88/26*** | (2006.01) |
| ***B65D 88/60*** | (2006.01) |
| ***B65D 90/58*** | (2006.01) |

(52) U.S. Cl.
CPC ..... *E21B 21/066* (2013.01); *B65D 88/26* (2013.01); *B65D 88/60* (2013.01); *B65D 90/587* (2013.01)

(58) Field of Classification Search
USPC ..... 175/66, 206, 207
See application file for complete search history.

(56) References Cited

U.S. PATENT DOCUMENTS

| | | | | |
|---|---|---|---|---|
| 5,375,747 | A * | 12/1994 | Yoshikawa et al. | 222/410 |
| 5,944,418 | A * | 8/1999 | Orr et al. | 366/245 |
| 6,244,362 | B1 | 6/2001 | Williams | |

(Continued)

*Primary Examiner* — Giovanna C Wright
*Assistant Examiner* — Richard Alker
(74) *Attorney, Agent, or Firm* — Buskop Law Group, PC; Wendy Buskop

(57) ABSTRACT

Systems and techniques, including a circle feeder, for the handling of drill cuttings, providing surge storage, rig buffer storage and wet and dry cuttings blending, including temporary storage of drill cuttings, optimizing storage capacity and the efficient and regulated movement of stored cuttings to a discharge port out of the hopper. Systems and techniques, maximize available space, provide optimized surge storage to optimize the use of downstream DPCS (and other transportation devices), provide optimized rig based storage and discharge, minimize or eliminate the occurrence of ratholing, bridging, degradation, segregation, and dehydration within the hopper, control and regulate the flow of cuttings from the hopper to the discharge port from the hopper, and provide metered discharge from the hopper storage, particularly when one hopper is discharging wet cuttings and a second hopper is discharging dry cuttings, and it is desirable to blend the wet and dry cuttings after such metered discharge.

2 Claims, 12 Drawing Sheets

(56) References Cited

U.S. PATENT DOCUMENTS

| | | | | |
|---|---|---|---|---|
| 6,416,261 | B2 * | 7/2002 | Martin | 406/128 |
| 6,508,583 | B1 * | 1/2003 | Shankwitz et al. | 366/196 |
| 6,530,438 | B1 | 3/2003 | McIntyre | |
| 6,585,115 | B1 | 7/2003 | Reddoch et al. | |
| 6,860,410 | B2 | 3/2005 | Yoshikawa | |
| 7,493,969 | B2 | 2/2009 | Burnett et al. | |
| 8,656,991 | B2 * | 2/2014 | Farrar et al. | 166/207 |
| 8,662,163 | B2 * | 3/2014 | Farrar et al. | 166/207 |
| 2003/0217866 | A1 | 11/2003 | deBoer | |
| 2004/0129611 | A1 | 7/2004 | Whitsel et al. | |
| 2005/0153844 | A1 | 7/2005 | McIntyre | |
| 2005/0242003 | A1 | 11/2005 | Scott et al. | |
| 2006/0086676 | A1 | 4/2006 | Smith | |
| 2006/0102390 | A1 | 5/2006 | Burnett et al. | |
| 2006/0185236 | A1 | 8/2006 | Hill | |
| 2007/0131454 | A1 * | 6/2007 | Hollier et al. | 175/66 |
| 2007/0131592 | A1 | 6/2007 | Browne et al. | |
| 2007/0183853 | A1 * | 8/2007 | Eide | 406/122 |

* cited by examiner

DRILL CUTTINGS METHODS AND SYSTEMS

BACKGROUND OF THE INVENTION

1. Field of the Invention

The present invention is directed to the handling, storage and disposal of earthen drill cuttings circulated out of an oil and gas well being drilled.

2. Description of Related Art

Drill cuttings are typically wet with drilling fluid and lose only a portion of the fluids on the rig shakers, leaving wet cuttings to address in an appropriate manner, consistent with economic constraints and environmental considerations, especially in an offshore environment. Drying processes include several well known techniques for drying the cuttings, which is often desirable, especially if any overboard disposal is intended.

Various transportation devices exist for moving the cuttings to various destinations, for further treatment and/or disposal, including, without implied limitation, gravity-drawn movement along troughs, augers (screw conveyors), vacuum systems, where the cuttings are pulled through conduits by creating a downstream pressure drop, and dense phase conveyance systems, where the cuttings are forced through conduits to another destination in response to positive pressure upstream. There are a few options available for the required bulk storage and transport, with some using a pneumatic ISO tank with conical bottoms and some using slider tanks with mechanical discharge systems.

In the offshore environment, particularly, it is often the case that the cuttings must be transported to onshore disposal facilities by boats, barges or other floating vessels. It is common for boat schedules, delays, bad weather and the like, to require the rig operator to store cuttings until the cuttings can be transported to storage on the boat. "Rig buffer storage," as used herein, includes all cases such as this where it is desirable to store large quantities of cuttings on the rigs while waiting for the opportunity to transport the same to the boat. At any point when the on-rig storage is full, the rig must cease drilling while waiting for a location to transport the cuttings generated by any continued drilling. This is often referred to as "NPT," an acronym for non-productive time, and is extremely expensive.

As to rig based storage, cuttings boxes on the rig can be used for this purpose, but their use requires extensive use of a crane and is a generally time consuming process. Other techniques and devices in the current art are available, as discussed in part below. The above-referenced dense phase conveyance system (herein "DPCS") has been implemented in various ways to move the cuttings, especially moving the cuttings down long hoses from rig based storage to boat storage, e.g. a fill station bank on the boat. It has also been used for receiving cuttings at the rig shaker and transporting the cuttings for treatment, e.g. to a desorption unit or to the rig based storage. A frequent problem faced by rig operators arises when cuttings are being generated and delivered to the DPCS at a rate faster than the DPCS can handle. This also causes NPT and is very expensive. No prior art is known which specifically provides "surge storage," as a means to accommodate a DPCS, such that rapidly accumulating cuttings can be stored until the DPCS can catch up. Conversely, it is also common for a low rate of cuttings accumulation to fall below the minimum cuttings supply requirements for operation of the DPCS. In this regard, surge storage is needed to allow the slow accumulation of cuttings until enough has accumulated to justify utilizing the DPCS, or until the rig begins a higher rate of cuttings generation. Such surge storage does not need to handle the large cuttings volumes that rig based storage requires.

The general problem of high cuttings generation rates requiring surge protection has been identified by McIntyre (U.S. Pat. No. 6,530,438; "McIntyre") although McIntyre does not contemplate use of his solution with a DPCS, and his approach is not optimized to eliminate the arching, ratholing, segregation, and/or degradation known to be associated with bulk storage of materials. For example, McIntyre feeds cuttings from the rig shaker to what appears, from the limited information provided, to be a funnel flow hopper (FIG. 2) with a simple line from the bottom with a variable rate valve. The "funnel flow" type of storage is known to be subject to ratholing (a vertical channel of movement above the opening, leaving materials in place, off to the side of the rathole), "last-in first-out" performance, material segregation, loss of much of the hopper's live capacity, and degradation, all of which make the hopper disclosed by McIntyre an unacceptable choice for any cuttings storage, surge storage or rig based storage. (Discharged cuttings, in the McIntyre system, are transported by an auger to a desorption chamber.)

Burnett, et al. (U.S. Pat. No. 7,493,969; "Burnett") at FIGS. 1-5, discloses a schematically depicted hopper receiving cuttings from the rig shakers. The hopper has a double cone bottom with each cone having steep sides, suggesting a mass flow hopper. However, the cones have long lengths, so available space is not maximized and each cone is more subject to arching. At a later point in the Burnett system (FIGS. 13A-13D), Burnett also discloses a straight-sided, flat bottom cuttings tank that generally provides more space efficient storage. This Burnett tank includes various flow assisters that slide back and forth in linear fashion to move cuttings, from both directions, toward a diametrically oriented slot in the flat bottom, the slot being aligned with and above a screw conveyor. As cuttings fill the tank the entire flat bottom and slot are covered. There is no provision for controlling the amount of cuttings moved to the slot, nor any provision for isolating the screw conveyor during off periods. Burnett also discloses rig buffer storage at a downstream point in its system (FIG. 11), which has a steep-sided, cone bottom hopper. An agitator screw (97) is intended to address the arching that is common to steep-sided cones. Available space is not maximized when using a hopper with steep-sided cones.

Eide (U.S. Published Patent Application 2007/0183853; "Eide") discloses a mass flow hopper for drill cuttings in which it is intended that drill cuttings enter a hopper with a lower truncated cone portion. The entering cuttings fall and strike a cone that extends upwardly to a distance that appears to enter the cylindrical portion of the tank above the truncated cone portion. The upward facing cone has six guide arms extending down the cone sides and across a short floor, with two of the arms continuing up the inside surface of the truncated cone. A discharge port is in the floor leading to a screw conveyor which is fully exposed to the cuttings in the hopper above. A gate valve (19) opens the discharge port variably and is intended to control the discharge rate. No control is available to regulate movement from the upward facing cone to the floor, resulting in the rapid vertical accumulation of cuttings between the upward facing cone and the hopper cone interior surface. After a period of time with the gate valve shut, the short portions of the arm adjacent the floor must overcome the full weight of the cuttings above. Furthermore, the significant size of the upward facing cone causes a reduction in space near the flat bottom. As a result a larger compactive force is present during times when the discharge port is closed, the larger compactive force significantly increasing the possibility of caking. The Eide device makes no provision for regulating or controlling the placement of cuttings above the discharge port, in that cuttings are free to fall onto the short floor portion as they enter the hopper and strike the upward facing cone.

No current products provide a reliable and flexible capability for metering the discharge of cuttings from a hopper or other storage vessel. This shortcoming prevents the operator from optimizing the use of the discharge cuttings for subsequent blending operations, particularly blending operations associated with various drying processes.

While the foregoing processes and treatments may function generally with respect to the purposes for which they were designed, they would not be as suitable for the purposes of the present invention, as hereinafter described. The options available are limited to volume they can hold due to pressure on mechanical equipment, very slow and poor discharge rates, and, in some cases, the need to dilute the stored cuttings with base oil to ensure it will flow. What is needed is a mass flow cuttings storage system and related techniques that will overcome the shortfalls in the products currently available in the market place, which will reduce NPT on the rig and/or service vessels as well as the costs associated with the additional base oil required and the increase in waste volume caused by the same. Systems and techniques are needed that maximize available space, provide optimized surge storage to optimize the use of downstream DPCS (and other transportation devices), provide optimized rig based storage and discharge, minimize or eliminate the occurrence of ratholing, bridging, degradation, segregation, and dehydration within the hopper, control the flow of cuttings from the hopper to the discharge port from the hopper, and provide metered discharge from the hopper storage, particularly when one hopper is discharging wet cuttings and a second hopper is discharging dry cuttings, and it is otherwise desirable to blend the wet and dry cuttings after such metered discharge.

SUMMARY OF THE INVENTION

The present invention overcomes the shortcomings of the prior art by providing systems and techniques for the handling of drill cuttings such that surge storage, rig buffer storage and wet and dry cuttings blending, which includes temporary storage of drill cuttings in a manner that optimizes storage capacity and the efficient and regulated movement of stored cuttings to a discharge port out of the hopper. Systems and techniques are provided that maximize available space, provide optimized surge storage to optimize the use of downstream DPCS (and other transportation devices), provide optimized rig based storage and discharge, minimize or eliminate the occurrence of ratholing, bridging, degradation, segregation, and dehydration within the hopper, control and regulate the flow of cuttings from the hopper to the discharge port from the hopper, and provide metered discharge from the hopper storage, particularly when one hopper is discharging wet cuttings and a second hopper is discharging dry cuttings, and it is otherwise desirable to blend the wet and dry cuttings after such metered discharge.

For use in a subterranean drilling operation of the type where earthen cuttings are produced, we have provided a method for the temporary storage of the cuttings, the method comprising: receiving the cuttings into a tank, the tank being positioned above a feeder, the feeder having an outer wall and an inner wall, a substantially flat floor having a first floor portion extending outwardly, a powered rotation member extending through the first floor portion, central sweep members, peripheral sweep members, a weir, an and a substantially flat second floor portion positioned about the first floor portion and extending to the outer wall, the second floor portion having a discharge port, the tank being configured such that cuttings received within the tank substantially cover the first floor portion, the accumulated cuttings forming a primary column above the first floor portion; sweeping the first floor portion with the central sweep members, the central sweep members being affixed to the powered rotation member, the powered rotation member positioning the sweep members proximate the first floor portion, the rotation of the central sweep members displacing cuttings toward and beyond the perimeter of the first floor portion onto the second floor portion; regulating the amount of cuttings being displaced from the first floor portion onto the second floor portion by alternatively lowering and raising the weir, the weir and the inner wall cooperating such that the lowered weir and the inner wall restrain sufficient cuttings above the first floor portion for formation of the primary column; sweeping the second floor portion with the peripheral sweep members, the peripheral sweep members being rotated by the powered rotation member and positioned proximate the second floor portion such that the peripheral sweep members displace cuttings along the second floor portion; discharging cuttings through the discharge port as the cuttings are displaced along the second floor portion; and receiving the discharged cuttings into a transportation device for transport away from the feeder, the receipt of cuttings being alternately terminated and started.

In exemplary embodiments of my invention, at least a portion of the discharged cuttings received into the transportation device are wet, and my method further comprises: receiving the transported wet cuttings in a first additional temporary storage in accordance with the above-described storage; metering the wet cuttings discharged from the first additional temporary storage; routing the metered wet cuttings to a drying process wherein the wet cuttings are at least partially dried; routing at least part of the at least partially dried cuttings for second additional temporary storage in accordance with the above-described storage; optionally, routing at least part of the at least partially dried cuttings from the drying process to storage on a floating vessel; metering the at least partially dry cuttings discharged from the second additional temporary storage; blending wet cuttings discharged from the additional temporary storage with the at least partially dried cuttings discharged from the second additional temporary storage; optionally, discharging the at least partially dried cuttings for overboard disposal; and routing the blend to the drying process.

In exemplary embodiments of my invention, at least a portion of the discharged cuttings received into the transportation device are wet, and my method further comprises: receiving the transported wet cuttings in a first additional temporary storage in accordance with the above-described storage; receiving the transported cuttings on a floating vessel; transporting the wet cuttings from the floating vessel using a transportation device for second additional second temporary storage in accordance with the above-described storage; metering the discharged wet cuttings from the first additional temporary storage; routing the metered wet cuttings to a drying process wherein the wet cuttings are at least partially dried; routing at least part of the at least partially dried cuttings for second additional temporary storage in accordance with the above-described storage; optionally, routing at least part of the at least partially dried cuttings from the drying process to onshore disposal; metering the discharged at least partially dry cuttings from the second additional temporary storage; blending wet cuttings discharged from the additional temporary storage with the at least partially dried cuttings discharged from the second additional temporary storage; optionally, discharging the at least partially dried cuttings for onshore disposal; and routing the blend to the drying process.

For use in a subterranean drilling operation of the type where earthen cuttings are produced, we have provided a method for the temporary storage of the cuttings, the method comprising: receiving the cuttings into a tank, the tank being positioned above a feeder, the feeder having an outer wall and an inner wall, a substantially flat floor having a first floor portion extending outwardly, a powered rotation member extending through the first floor portion, central sweep members, peripheral sweep members, a weir, an and a substantially flat second floor portion positioned about the first floor portion and extending to the outer wall, the second floor portion having a discharge port, the tank being configured such that cuttings received within the tank substantially cover the first floor portion; sweeping the first floor portion with the central sweep members, the central sweep members being affixed to the powered rotation member, the powered rotation member positioning the sweep members proximate the first floor portion, the rotation of the central sweep members displacing cuttings toward and beyond the perimeter of the first floor portion onto the second floor portion; regulating the amount of cuttings being displaced from the first floor portion onto the second floor portion by alternatively lowering and raising the weir, the weir and the inner wall cooperating such that the lowered weir and the inner wall restrain substantially all the cuttings above the first floor portion; sweeping the second floor portion with the peripheral sweep members, the peripheral sweep members being rotated by the powered rotation member and positioned proximate the second floor portion such that the peripheral sweep members displace cuttings along the second floor portion; discharging cuttings through the discharge port as the cuttings are displaced along the second floor portion; and receiving the discharged cuttings into a transportation device for transport away from the feeder, the receipt of cuttings being alternately terminated and started.

For use in a subterranean drilling operation of the type where earthen cuttings are produced, we have provided a system for the temporary storage of the cuttings, the system comprising: a transportation device for moving cuttings; a tank for receiving the cuttings moved by the transportation; a feeder beneath the tank, the feeder having an outer wall and an inner wall, a substantially flat floor having a first floor portion extending outwardly, a powered rotation member extending through the first floor portion, central sweep members, peripheral sweep members, a weir, an and a substantially flat second floor portion positioned about the first floor portion and extending to the outer wall, the second floor portion having a discharge port, the tank being configured such that cuttings received within the tank substantially cover the first floor portion, the accumulated cuttings forming a primary column above the first floor portion; the feeder being further configured such that the central sweep members sweep the first floor portion, the central sweep members being affixed to the powered rotation member, the powered rotation member positioning the sweep members proximate the first floor portion, the rotation of the central sweep members displacing cuttings toward and beyond the perimeter of the first floor portion onto the second floor portion; the weir being further configured for regulating the amount of cuttings being displaced from the first floor portion onto the second floor portion by alternatively being moved between lower and higher positions, the weir and the inner wall cooperating such that the lowered weir and the inner wall restrain sufficient cuttings above the first floor portion for formation of the primary column; the feeder being further configured such that the peripheral sweep members sweep the second floor portion, the peripheral sweep members being rotated by the powered rotation member and positioned proximate the second floor portion such that the peripheral sweep members displace cuttings along the second floor portion; the feeder being further configured such that cuttings are discharged through the discharge port as the cuttings are displaced along the second floor portion; and a second transportation device for receiving the discharged cuttings for transport away from the feeder, the receipt of cuttings being alternately terminated and started.

For use in a subterranean drilling operation of the type where earthen cuttings are produced, we have provided a method for the temporary storage of the cuttings, the method comprising: receiving the cuttings into a tank, the tank being positioned above a feeder, the feeder having an outer wall and an inner wall, a substantially flat floor having a first floor portion extending outwardly, a powered rotation member extending through the first floor portion, central sweep members, peripheral sweep members, a weir, an and a substantially flat second floor portion positioned about the first floor portion and extending to the outer wall, the second floor portion having a discharge port, the tank being configured such that cuttings received within the tank substantially cover the first floor portion, the accumulated cuttings forming a primary column above the first floor portion; sweeping the first floor portion with the central sweep members, the central sweep members being affixed to the powered rotation member, the powered rotation member positioning the sweep members proximate the first floor portion, the rotation of the central sweep members displacing cuttings toward and beyond the perimeter of the first floor portion onto the second floor portion; regulating the amount of cuttings being displaced from the first floor portion onto the second floor portion by adjusting the rotational speed of the central sweep members, the weir and the inner wall cooperating such that the lowered weir and the inner wall restrain sufficient cuttings above the first floor portion for formation of the primary column; sweeping the second floor portion with the peripheral sweep members, the peripheral sweep members being rotated by the powered rotation member and positioned proximate the second floor portion such that the peripheral sweep members displace cuttings along the second floor portion; discharging cuttings through the discharge port as the cuttings are displaced along the second floor portion; and receiving the discharged cuttings into a transportation device for transport away from the feeder, the receipt of cuttings being alternately terminated and started.

The foregoing features and advantages of my invention will be apparent from the following more particular descriptions of exemplary embodiments of the invention as illustrated, in some exemplary embodiments, in the accompanying drawings.

DETAILED DESCRIPTION OF EXEMPLARY EMBODIMENTS

The following discussion describes exemplary embodiments of the invention in detail. This discussion should not be construed, however, as limiting the invention to those particular embodiments. Practitioners skilled in the art will recognize numerous other embodiments as well.

Figure 1:
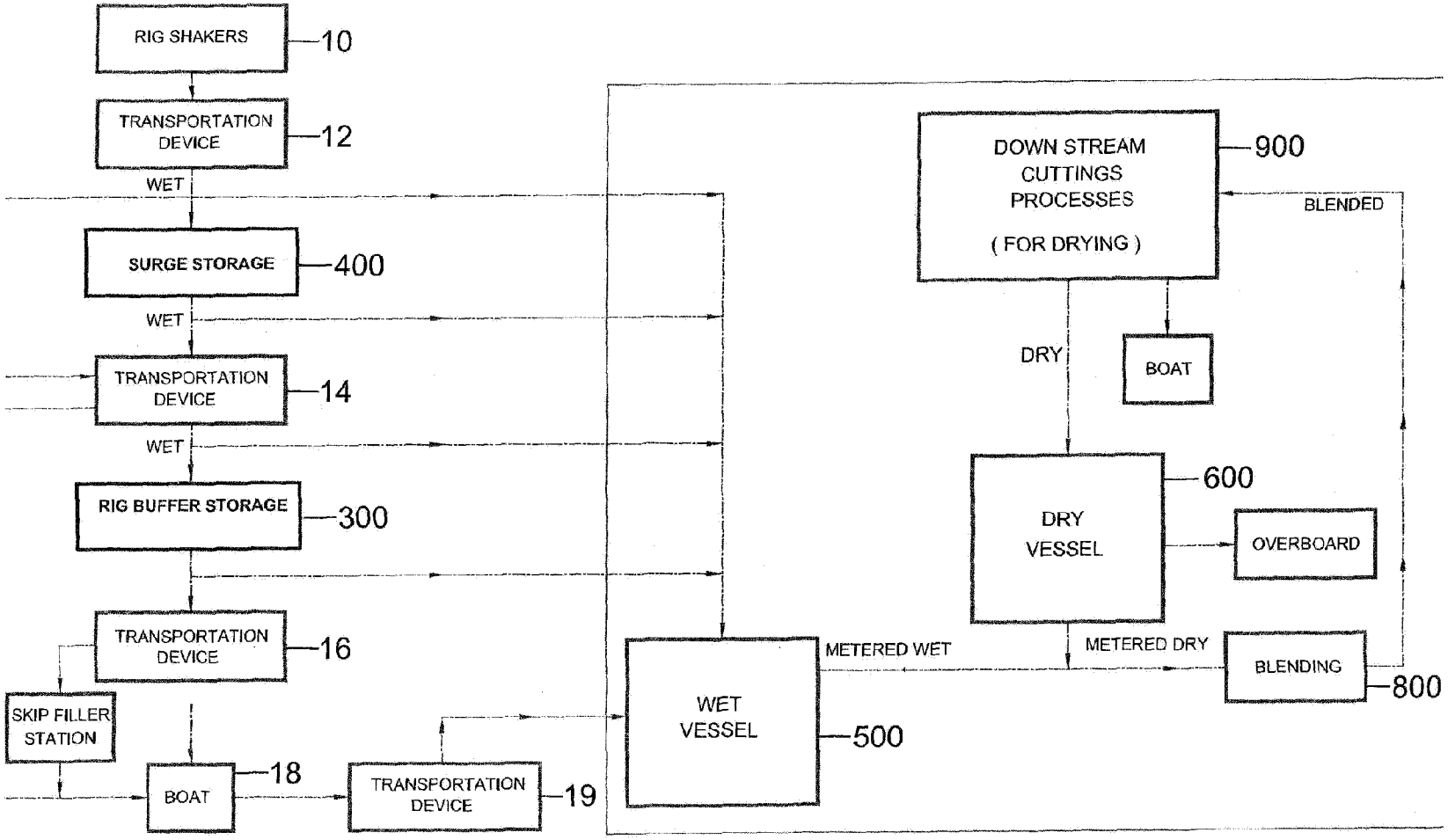
FIG. 1 is a schematic representation of exemplary embodiments of the present invention.
Figure 2:
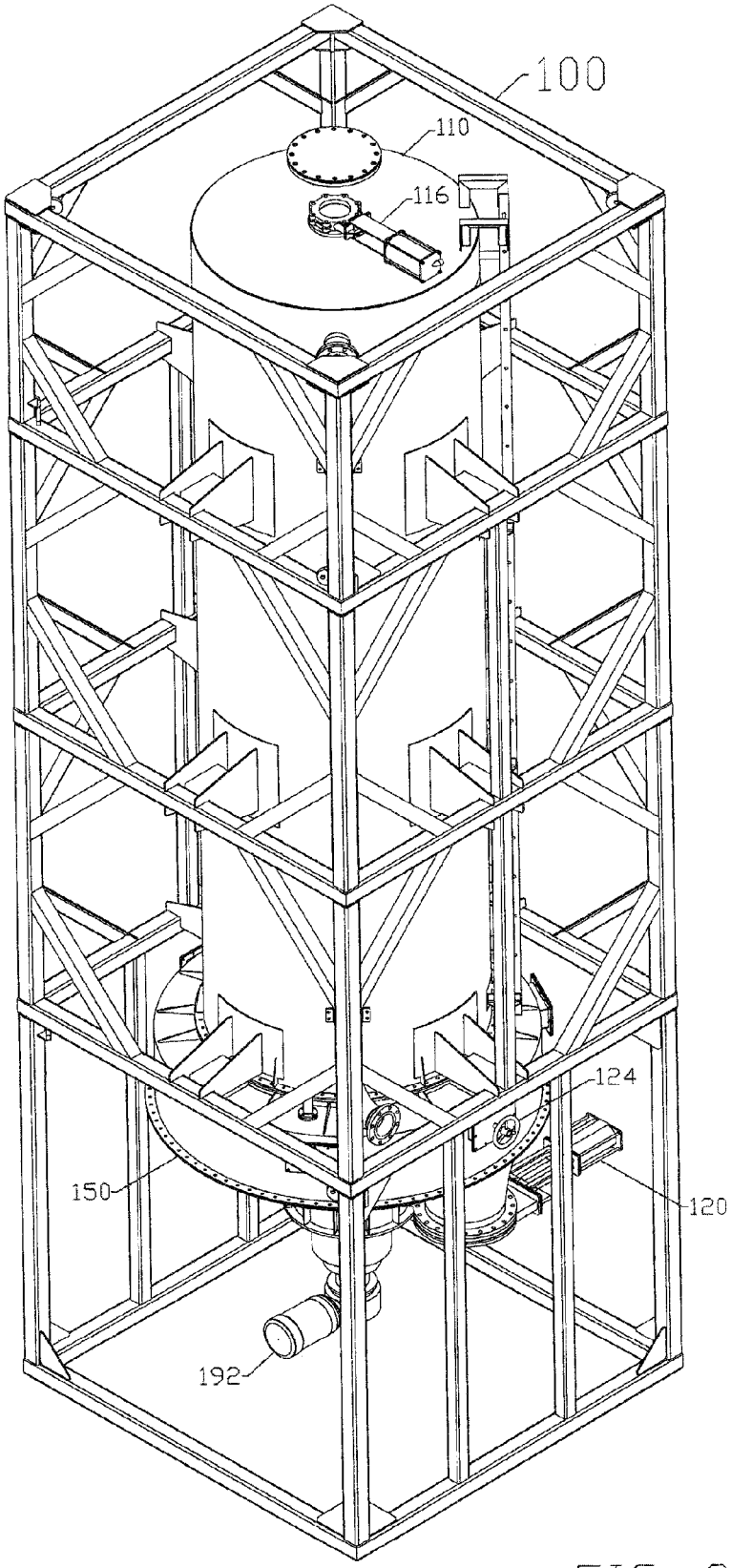
FIG. 2 is an oblique view of apparatus usable in exemplary embodiments of the present invention.
Figure 3:
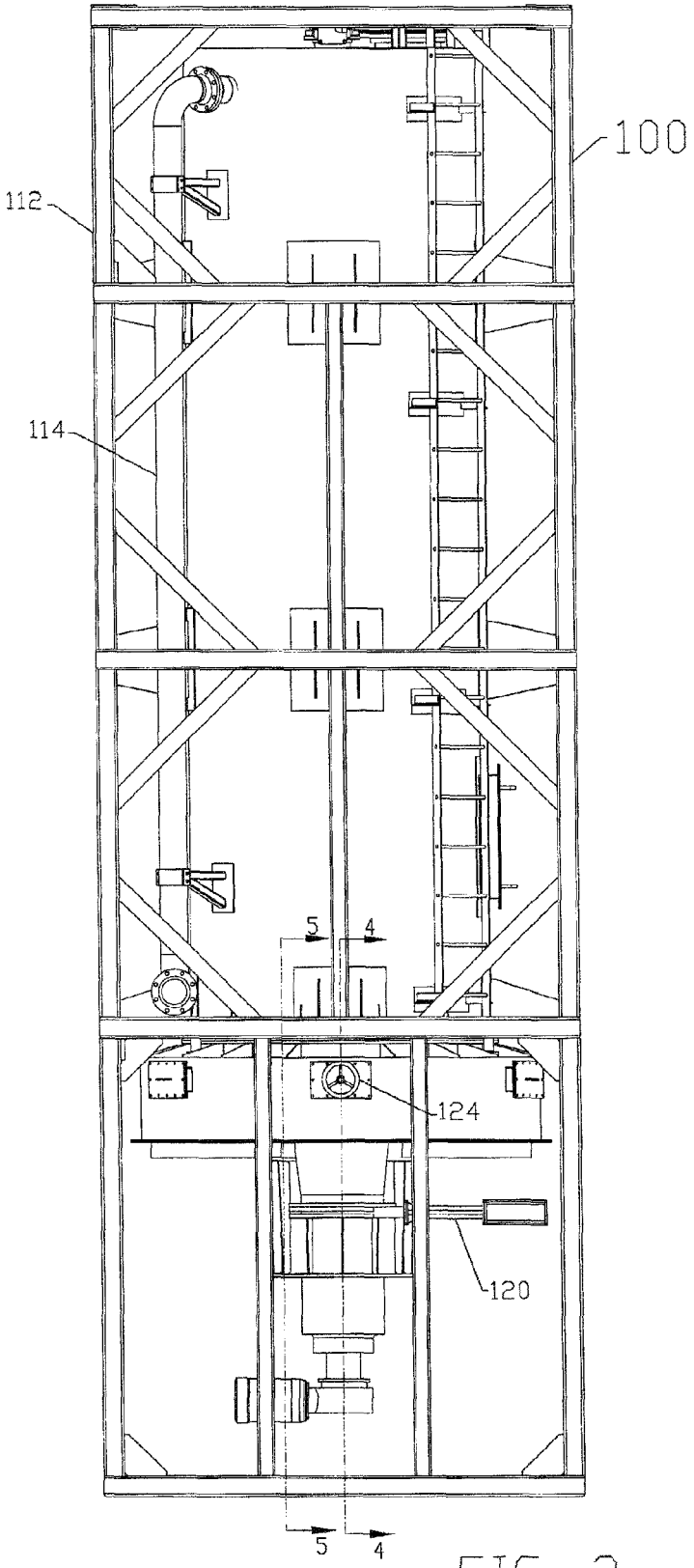
FIG. 3 is a side view of apparatus usable in exemplary embodiments of the present invention.
Figure 4:
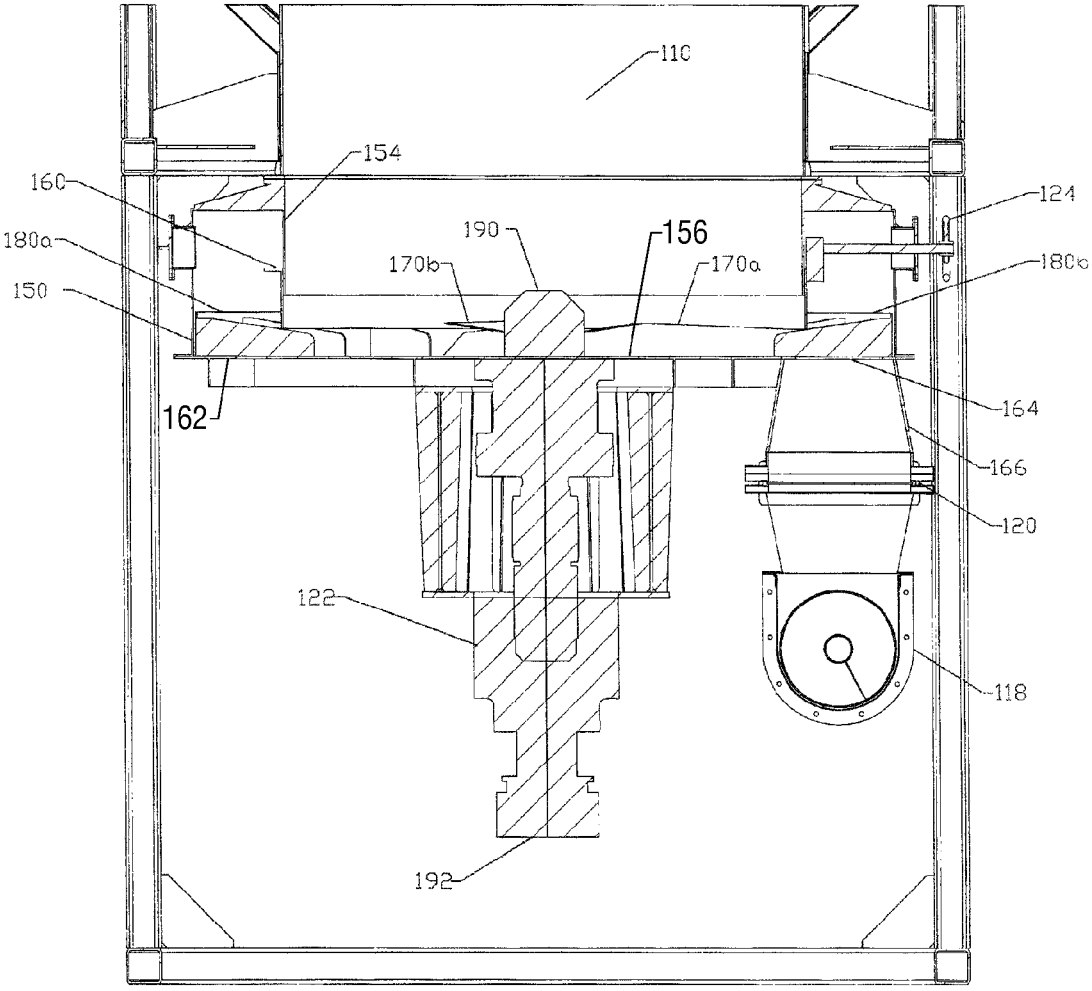
FIG. 4 is a sectional view of apparatus usable in exemplary embodiments of the present invention cut along the section line 4-4 as shown in FIG. 3.
Figure 5:
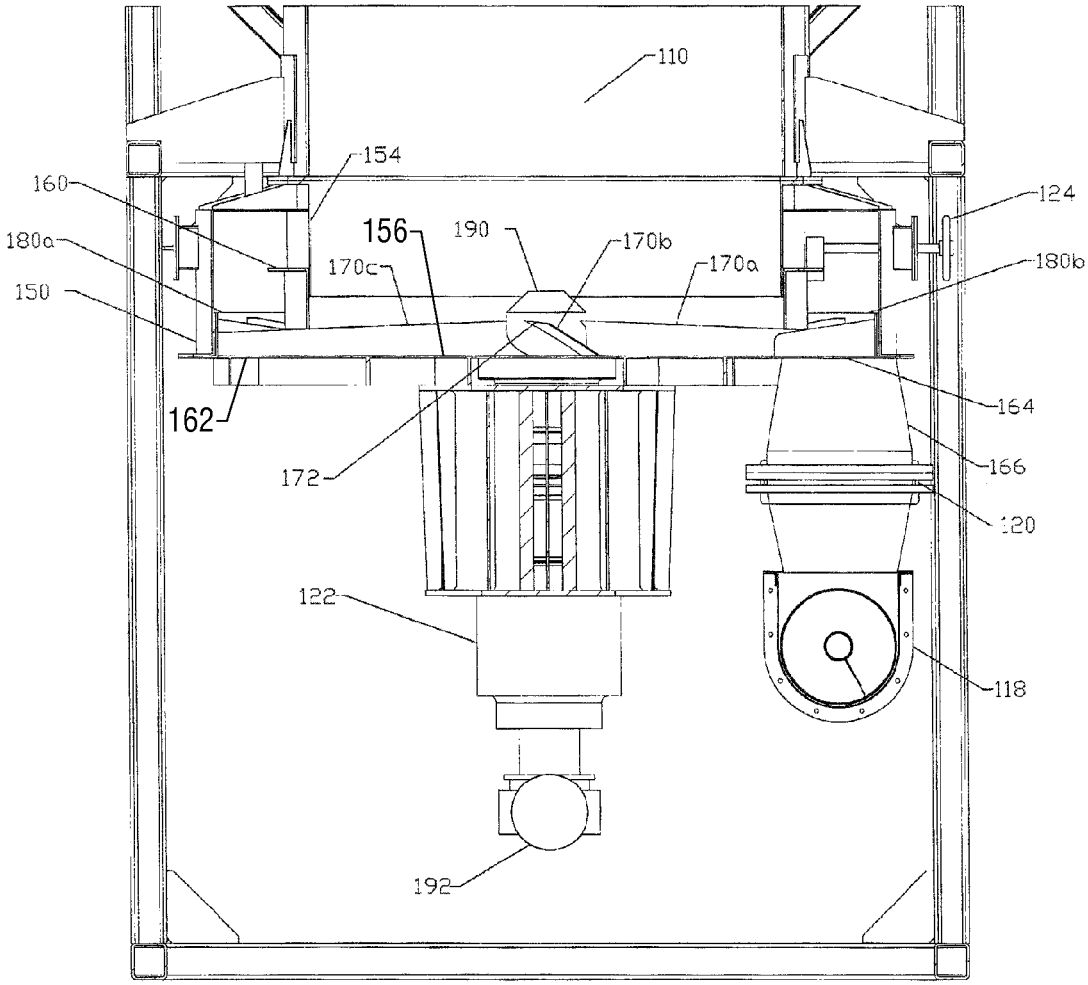
FIG. 5 is a sectional view of apparatus usable in exemplary embodiments of the present invention cut along the section line 5-5 as shown in FIG. 3.

Turning now to FIG. 1, wherein exemplary embodiments of the present invention are set forth schematically. In some exemplary embodiments of the type shown in FIG. 1, methods and the apparatus, for temporarily storing cuttings, are schematically represented by the rig buffer storage 300 and also by the surge storage 400. Cuttings are transported 12 from the rig shakers 10 to such apparatus using one or more transportation devices.

Figure 6:
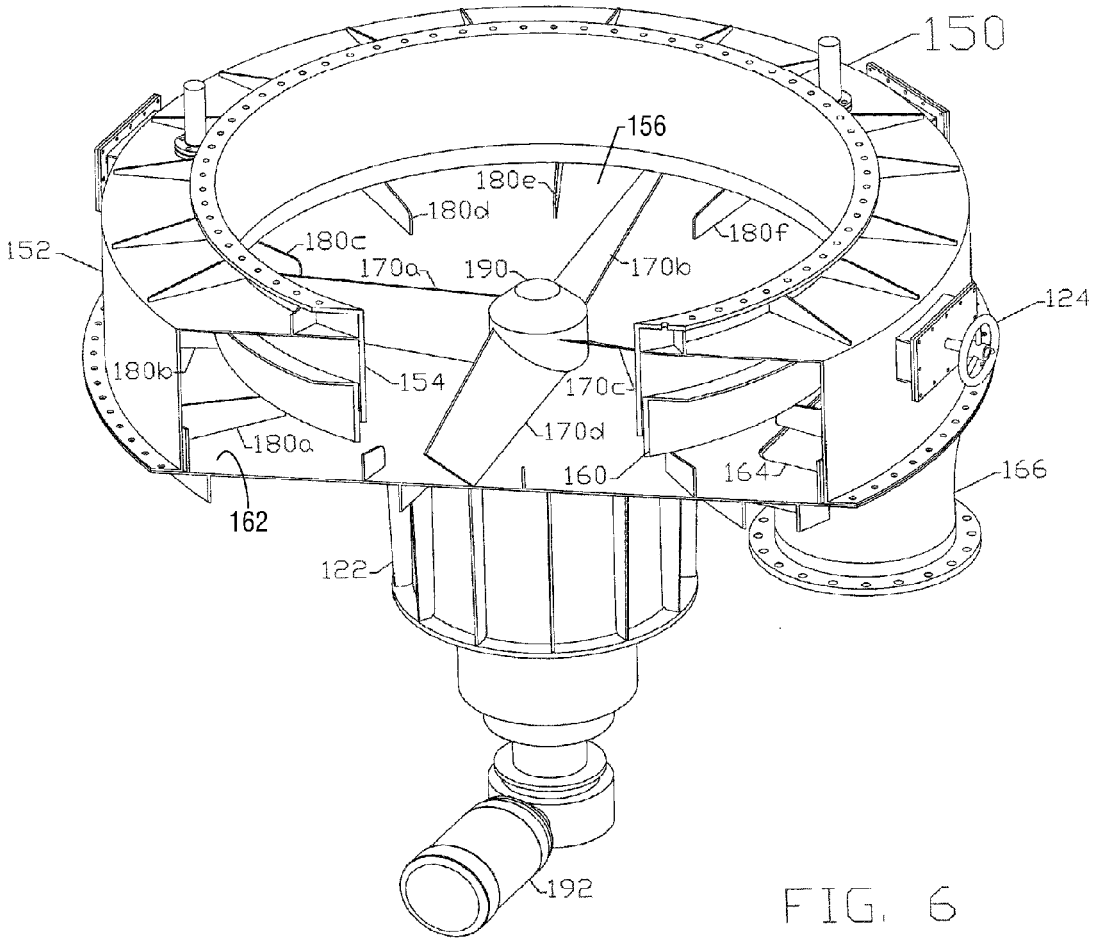
FIG. 6 is a partial sectional view of apparatus usable in exemplary embodiments of the present invention.
Figure 7:
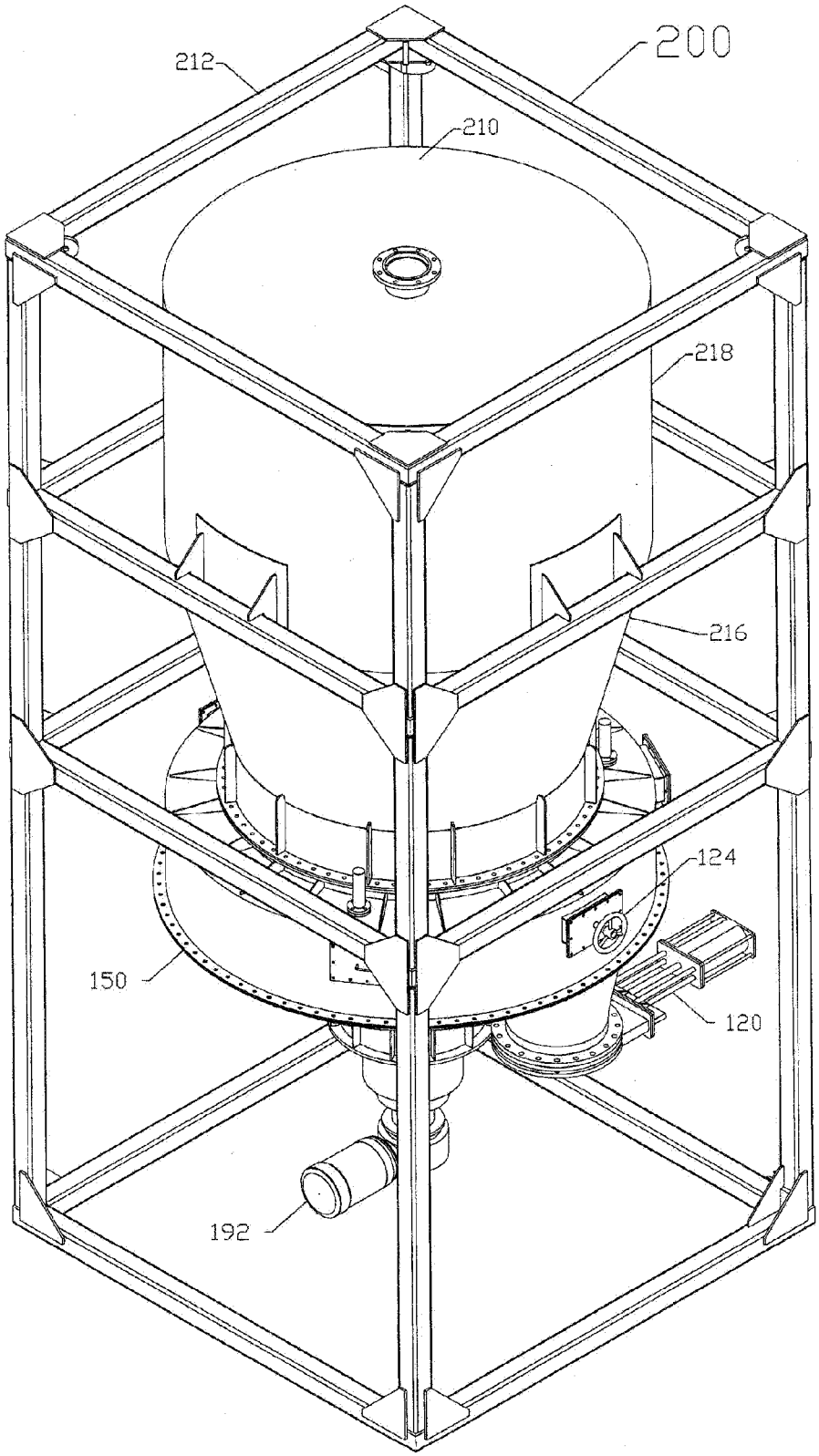
FIG. 7 is an oblique view of apparatus usable in exemplary embodiments of the present invention.
Figure 8:
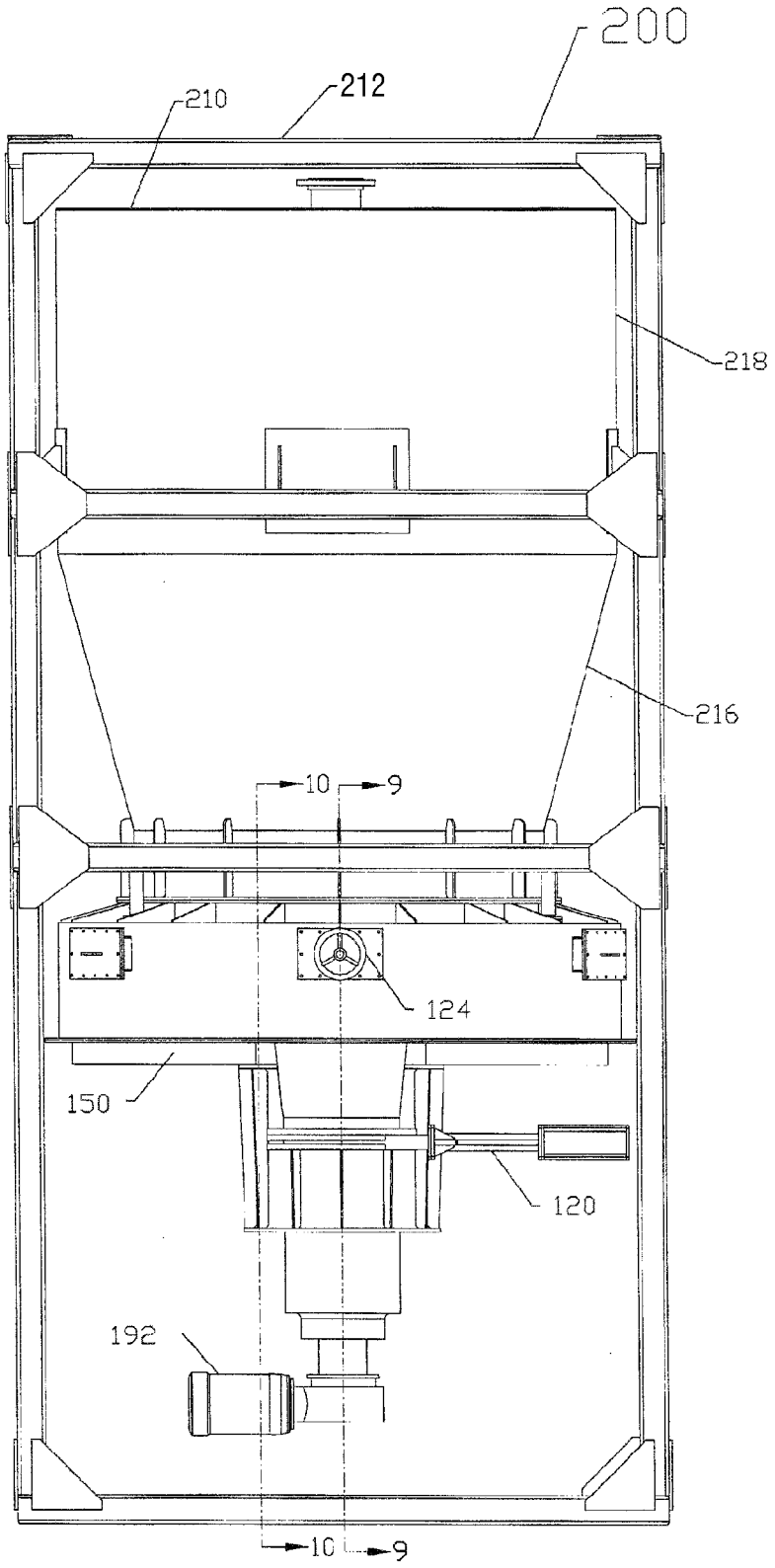
FIG. 8 is a side view of apparatus usable in exemplary embodiments of the present invention.
Figure 9:
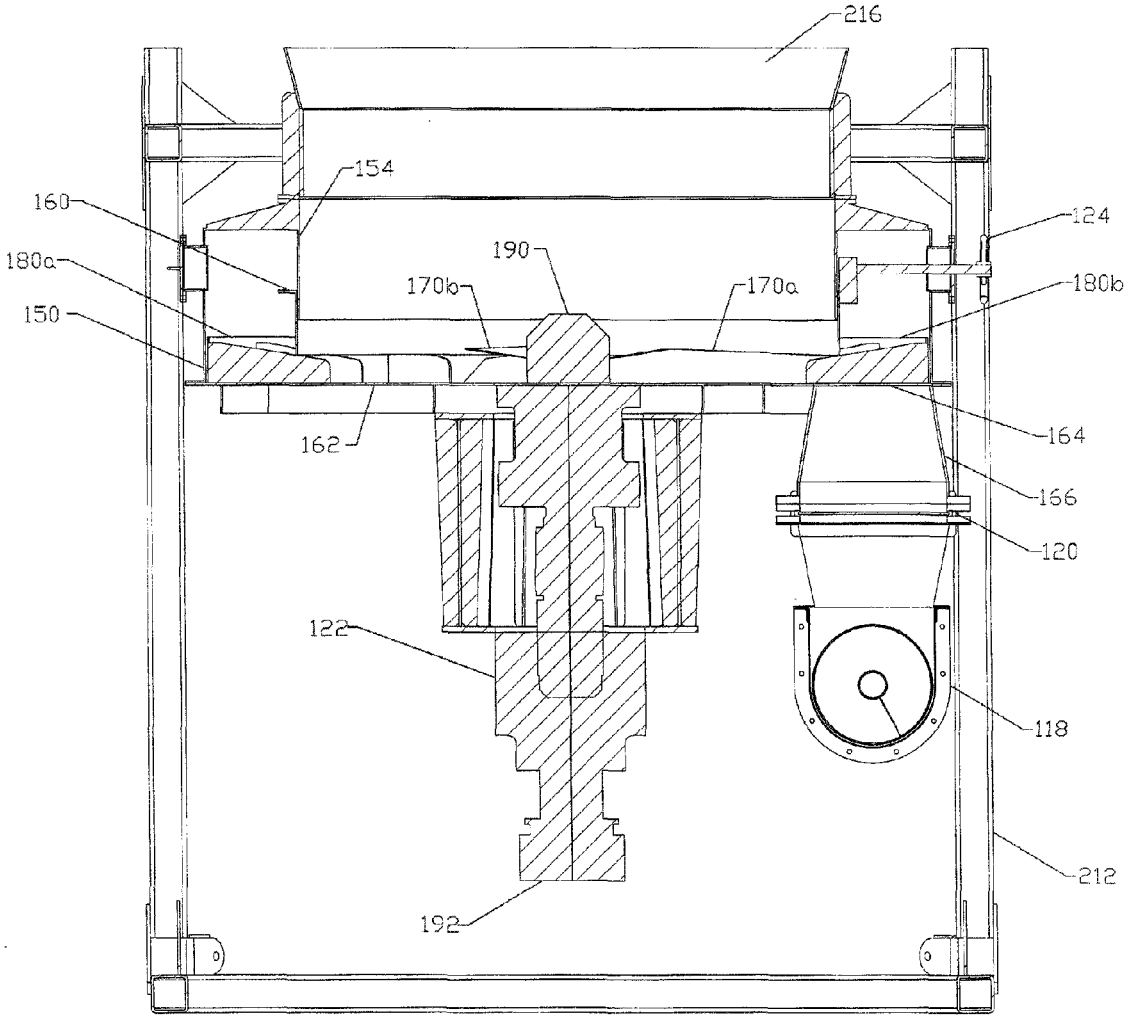
FIG. 9 is a sectional view of apparatus usable in exemplary embodiments of the present invention cut along the section line 9-9 as shown in FIG. 8.
Figure 10:
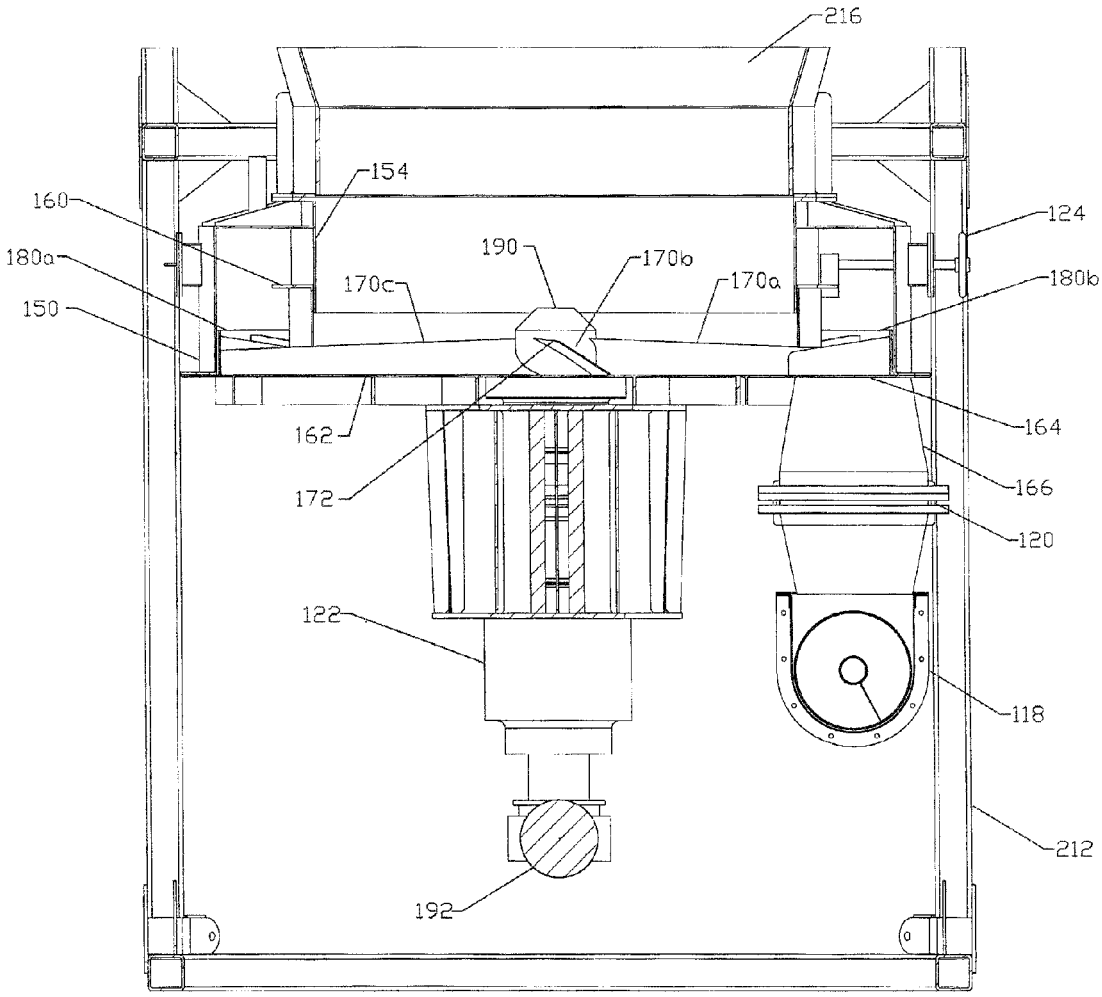
FIG. 10 is a sectional view of apparatus usable in exemplary embodiments of the present invention cut along the section line 10-10 as shown in FIG. 8.

Turning now to FIGS. 2-6, in which an exemplary embodiment of a bulk storage unit 100, suitable for use as rig buffer storage and/or surge storage, is depicted and shown to include a tank 110 attached to a mass flow feeder 150, both being mounted in a frame 112. The cuttings are received into the tank 110 through tank inlet 114, the tank being positioned above the mass flow feeder 150, the mass flow feeder having an outer wall 152 and an inner wall 154, a substantially flat floor having a first floor portion 156, a powered rotation member 190 extending through the first floor portion, central sweep members 170*a-d*, concentrically-spaced peripheral sweep members 180*a-f* (not all shown), a weir 160, and a substantially flat second floor portion 162 positioned about the first floor portion and extending to the outer wall, the second floor portion having a discharge port 164. The inner wall 154 is substantially aligned with, and attached to the tank 110. The tank is configured, such that cuttings received within the tank substantially cover the first floor portion. In some exemplary embodiments, a motor 192 is used to rotate the powered rotation member, and in some exemplary embodiments the rotation is hydraulically powered (related conventional equipment not shown). The motor 192 rotates central sweep members 170*a-d* (rotating vanes) and peripheral sweep members 180*a-f* through conventional gear reduction equipment 122. In exemplary embodiments of the type shown in FIGS. 2-6, the central sweep members 170*a-d* are attached to the powered rotation member 190 and are positioned proximate the first floor portion. As shown in FIG. 6, the central sweep members in some exemplary embodiments have a forward lean and a chamfered edge 172, such that as they are rotated clockwise about the first floor portion 156, the edge 172 separates a portion of the accumulated cuttings and partially encompasses such cuttings as the cuttings move outwardly toward and beyond the first floor portion and onto the second floor portion 162. As discussed below, the central sweep members and peripheral sweep members are constructed, in some exemplary embodiments, from materials that minimize wear on such members due to abrasion.

In such exemplary embodiments, as cuttings leave the first floor portion 156 the cuttings pass under the inner wall 154, the vertical clearance beneath the inner wall being varied according to the position of the adjustment ring/weir 160, which is manually adjustable and set using a hand operated wheel 124. This allows the regulation of the amount of cuttings displaced from the first floor portion onto the second floor portion. When the weir 160 is in a lowered position, the weir and the inner wall 154 cooperate to restrain substantially all the cuttings in a position above the first floor portion, referred to herein, in some instances, as a "primary column." The amount of cuttings displaced from the first floor portion onto the second floor portion is also regulated by adjusting the rotational speed of the central sweep members 170*a-d*.

The phrase "substantially all," in this regard, addresses the large majority of the cuttings. For example, in some exemplary embodiments of the type depicted in FIGS. 2-6, the weir 160 encounters the central sweep members 170*a-d* as the weir is lowered, leaving a small vertical clearance through which some much smaller amount of cuttings may be displaced during rotation of the peripheral sweep members 180*a-f*, and through which some even smaller amount of cuttings may settle when the tank receives cuttings and before the central sweep members are rotated. In such exemplary embodiments, however, even when the weir 160 is fully raised the inner wall 154 continues to restrain a large majority of the cuttings above the first floor portion 156 as the primary column. By way of further example, in some exemplary embodiments of the type depicted in FIGS. 2-6, the discharge port 162 extends beneath the weir 160 and the inner wall 154 and into the first floor portion 156, allowing only a small amount of cuttings to drop through the discharge port 164. This results in only a negligible displacement of cuttings from the primary column.

Furthermore, in some exemplary embodiments of the type illustrated in FIGS. 2-6, the peripheral sweep members 180*a-f* are attached to the central sweep members 170*a-d* for simultaneous, clockwise rotation, with the peripheral sweep members being positioned proximate the second floor portion 162 and spaced about the perimeter, such that cuttings along the second floor portion are swept along a path marked on the inside by the cooperating inner wall 154 and weir 160 and on the outside by the outer wall 152, a path in which substantially all of the discharge port 164 is positioned, such that the cuttings fall through the discharge port. In some exemplary embodiments of the type illustrated in FIGS. 2-6, a discharge conduit 166 is provided to route the discharged cuttings to a transportation device such as an auger 118 or DPCS. A knife gate valve 120 is provided in some exemplary embodiments for stopping the amount of cuttings being routed to the transportation device.

Some exemplary embodiments utilizing the unit 100 illustrated in FIGS. 2-6 are sized and configured for use as rig buffer storage 300 and some for surge storage 400, and in some exemplary embodiments, both configurations are utilized. For example, exemplary methods are depicted in FIG. 1 where in some exemplary embodiments a transportation device 12, e.g. a shaker trough or auger or a combination of the two is used to route the cuttings to the surge storage tank inlet 114, with any involved and/or resulting pressure being released through a tank vent 116. In some exemplary embodiments, cuttings discharged from the surge storage 300 unit 100 through the discharge port 164 are then transported by auger 118 to another transportation device 14, e.g. a DPCS, by which the cuttings are then transported to one or more rig buffer storage 400 units 100 at the inlet 114, with any involved and/or resulting pressure being released through tank vent 116 or routed to conventional collection means. In other embodiments the transportation device 14 used to so deliver cuttings is an auger, alone, or a vacuum system. In such exemplary embodiments, cuttings discharged from the rig buffer storage 400 unit 100 through the discharge port 164 are then transported by auger 118 to another transportation device 14, e.g. a DPCS, by which the cuttings are then transported to a skip fill station on or near the rig or to a floating vessel, such as a supply boat 18, the boat typically having conventional cuttings boxes, but, in some exemplary embodiments, the boat has one or more bulk storage units of the same type as the unit 100.

Turning now to FIGS. 7-10, an exemplary embodiment of the present invention is depicted and is shown to be a bulk storage unit 200 suitable for use as rig buffer storage 300 and/or surge storage 400. It is shown to include a tank 210 attached to a mass flow feeder 150 (similar in all significant aspects to the mass flow feeder in the bulk storage unit 100 discussed above), both being mounted in a frame 212. The cuttings are received into the tank 210 through a tank inlet (not shown), the tank being positioned above the mass flow feeder 150. In exemplary embodiments of the type illustrated in FIGS. 7-10, the tank 210 has an abbreviated frusto-conical section 216, positioned below the cylindrical tank portion 218, and a reduced diameter abbreviated cylindrical portion 220 extending downwardly from the frusto-conical section to join the mass flow feeder inner wall 154. The enlarged tank diameter above the frusto-conical section allows more efficient use of available space, even beyond the highly efficient use of space made available through the use of the full cylindrical unit 100. The frusto-conical tank unit 200 is usable for both rig buffer storage 300 and surge storage 400, and is interchangeable with the unit 100 in FIGS. 2-5, in the exemplary embodiments described herein.

Figure 11:
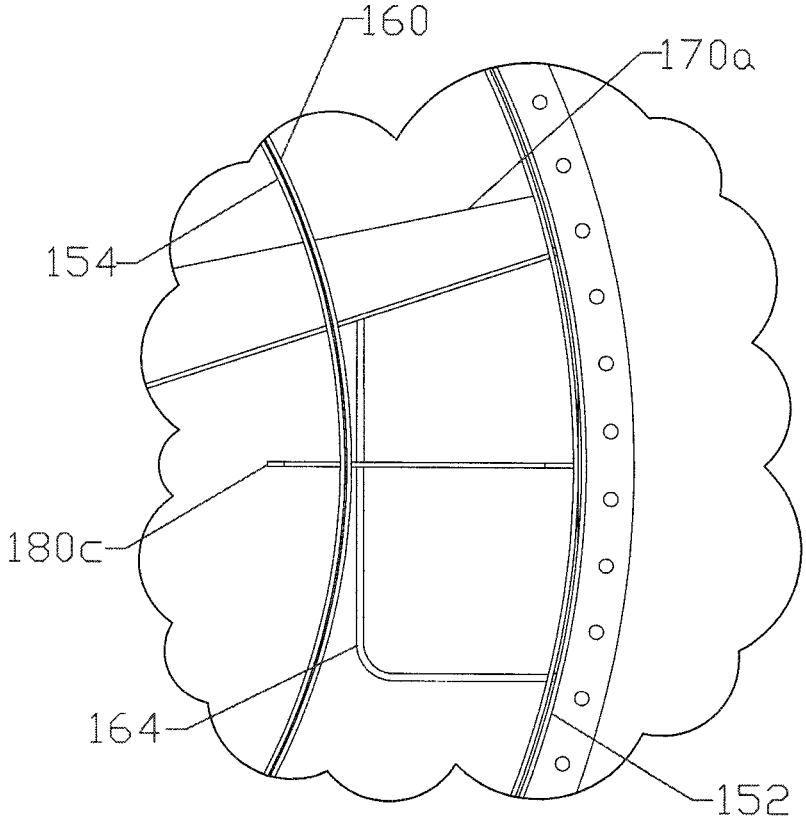
FIG. 11 is a partial top view of the area around and including the discharge port in exemplary embodiments of the present invention.

In some exemplary embodiments of the present invention, and as shown in FIG. 11, the discharge port is sized and configured such that the port is fully contained on the second floor portion, that is, the discharge port does not extend beneath the weir 160 and into the first floor portion 156, but is fully contained within the second floor portion 162, as depicted in FIG. 11.

Figure 12:
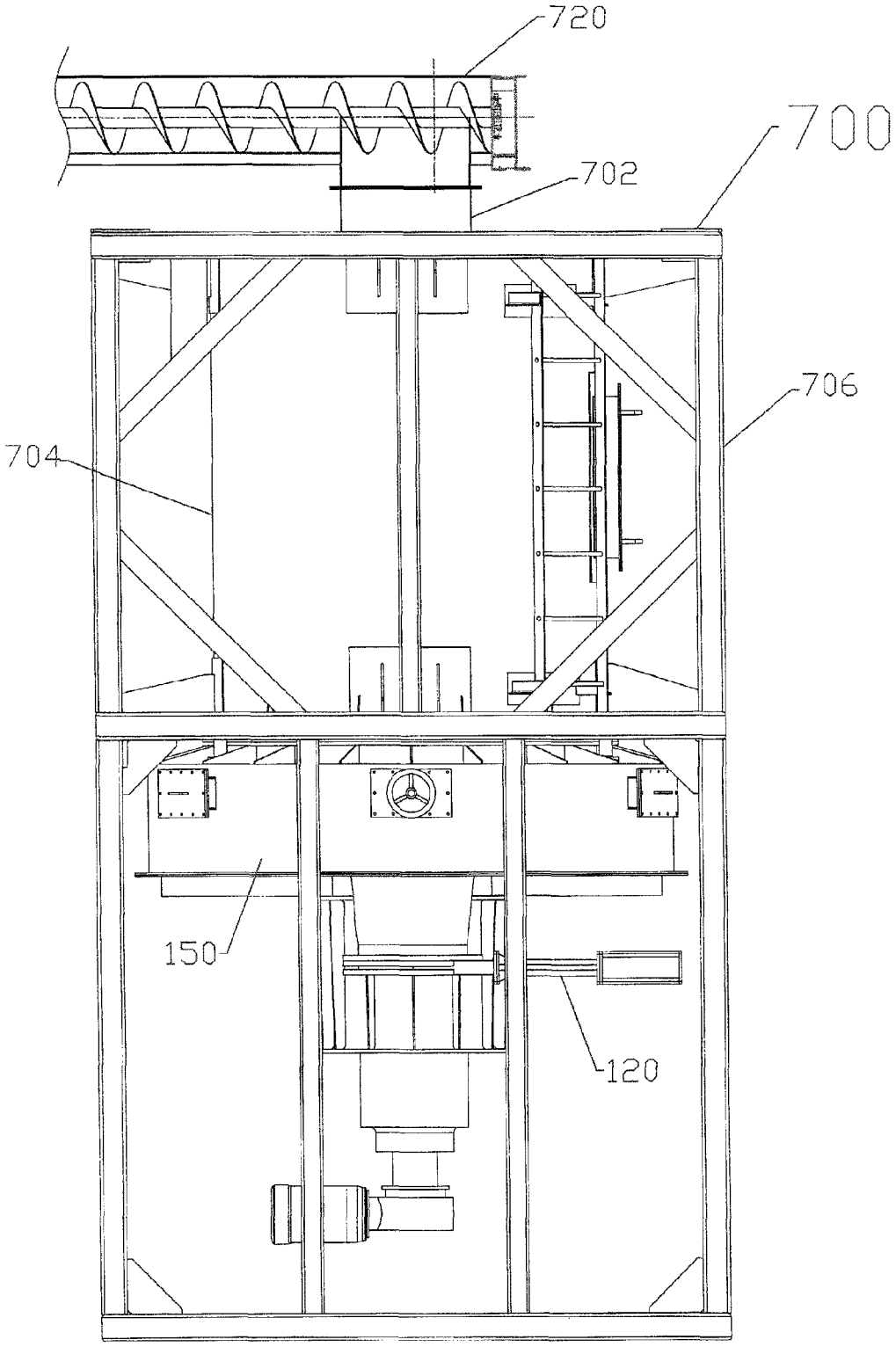
FIG. 12 is a side view of apparatus usable in exemplary embodiments of the present invention.

Turning now to FIG. 12, wherein exemplary embodiment of a storage unit 700 usable in the present invention is shown to be configured and sized for surge storage in particular. The unit 700 is similar in operative aspects to the unit 100 depicted in FIGS. 2-6, however, cuttings enter the tank 704 by gravity through a top opening 702. In some exemplary embodiments, utilizing the unit 700 a transportation device 12, e.g. a shaker trough or auger 720 or a combination of the two is used to route the cuttings to the surge storage tank top opening 702. In some exemplary embodiments, cuttings discharged from the surge storage 300 unit 700 through a discharge port similar in operative aspects to the discharge ports discussed above, are then transported by auger to another transportation device 14, e.g. a DPCS, by which the cuttings are then transported to one or more rig buffer storage 400 units 100 at the inlet 114, with any involved and/or resulting pressure being released through tank vent 116 or routed to conventional collection means. In other embodiments the transportation device 14 used to so deliver cuttings is an auger, alone, or a vacuum system. In such exemplary embodiments, cuttings discharged from the rig buffer storage 400 unit 100 through the discharge port 164 are then transported by auger 118 to another transportation device 14, e.g. a DPCS, by which the cuttings are then transported to a skip fill station on or near the rig or to a floating vessel, such as a supply boat 18, the boat typically having conventional cuttings boxes, but, in some exemplary embodiments, the boat has one or more bulk storage units of the same type as the unit 100. This configuration is particularly suited to a smaller tank 704 and frame 706 being positioned beneath the rig shaker trough discharge or rig shaker auger discharge.

Turning again to FIG. 1, wherein an exemplary embodiment is illustrated and shown to include a method of metering wet and dry cuttings from two appropriately sized and configured bulk storage units 100. In such exemplary embodiments, at least a portion of the discharged cuttings received into one or more of the transportation devices (12, 14, 16) are wet, and such wet cuttings are received into a wet vessel 500 (similar in all significant aspects to the bulk storage unit 100). The wet vessel in such exemplary embodiments is used to meter the discharge of the cuttings from the vessel by adjusting the rotational speed of the central sweep members 170*a-d*, the above-described feeder allowing significantly more control over the discharge rate than the current prior art. The metered wet cuttings are then routed to a drying process where the cuttings are at least partially dried, such dried cuttings then being routed to a dry vessel 600 (similar in all significant aspects to the bulk storage unit 100). The dry vessel in such exemplary embodiments is used to meter the discharge of the dry cuttings from the dry vessel by adjusting the rotational speed of the central sweep members 170*a-d*, the dry cuttings discharged from the dry vessel 600 then being blended 800 with the wet cuttings discharged from the wet vessel 500, the blend being routed to the drying process 900 and/or to another process. In some exemplary embodiments, blending equipment for cuttings discharged from the wet vessel and dry vessel will be a conventional pug mill, an airlock feeder (rotary valve or flap gate), receiving the blend after the pug mill. In some exemplary embodiments of the type illustrated in FIG. 1, at least part of the at least partially dried cuttings from the drying process are routed to a floating vessel, while in some exemplary embodiments at least part of the at least partially dried cuttings are discharged from the dry vessel and routed for overboard disposal. Prospectively, processes using the blended wet and dry cuttings in some exemplary embodiments, include, hot oil thermal desorption, microwave treatment, friction type thermal desorption, chemical wash, chemically enhanced centrifugation, bioremediation and an extractor cuttings dryer.

FIG. 1 also illustrates exemplary embodiments of the present invention wherein wet cuttings from the rig are received on a floating vessel 18, and later transported from the floating vessel to land, using a transportation device 19, for temporary storage in a wet vessel 500 (similar in all significant aspects to the bulk storage unit 100). Wet cuttings metered and discharged from the first additional temporary storage are then routed to a drying process wherein the wet cuttings are at least partially dried, then routing at least part of the dried cuttings for temporary storage in a dry vessel 600 (similar in all significant aspects to the bulk storage unit 100). The dried cuttings metered and discharged from the dry vessel 600 are blended with wet cuttings from the wet vessel 500, the blended cuttings then being routed to the drying process. In some exemplary embodiments, at least part of the dried cuttings from the drying process are routed to onshore disposal, and in some exemplary embodiments dried cuttings discharge from the dry vessel are routed to onshore disposal.

Turning again to the exemplary embodiments illustrated in FIGS. 2-6, wherein the bulk storage units 100, will prospectively be sized in some exemplary embodiments to hold up to 12.16 cubic meters, when used as rig buffer storage 300. In exemplary embodiments of the type illustrated in FIGS. 7-10, the bulk storage units 200, will prospectively be sized in some exemplary embodiments to hold up to 15.95 cubic meters, when used as rig buffer storage 300. In exemplary embodiments of the type illustrated in FIG. 12, the bulk storage units 700 will prospectively be sized in some exemplary embodiments to hold up to 7.84 cubic meters when used as surge storage 400. In some exemplary embodiments of the type illustrated in FIGS. 2-10, 12, the bulk storage units will prospectively be sized in some exemplary embodiments to hold up to 2-4 cubic meters when used as a wet vessel 500 or dry vessel 600.

In some exemplary embodiments, prospective materials include carbon steel or stainless steel for the tanks 110,210, carbon steel for the frames 112,212, carbon steel, stainless steel, or fiberglass for the inlets 114, carbon steel or stainless steel for the mass flow feeder floor portions 156,162, carbon steel, hard steel, hard faced carbon steel, or hard steel tungsten carbide for the rotation member 190, carbon steel for gear reduction equipment 122 linking the motor 192 and the rotation member 190, carbon steel or stainless steel for the discharge conduit 166, carbon steel, hard steel, hard faced carbon steel, or hard steel tungsten carbide for the central sweep members 170*a-d*, carbon steel, hard steel, hard faced carbon steel, hard faced carbon steel, or hard steel tungsten carbide for the peripheral sweep members 180*a-f*, carbon steel or stainless steel for the mass flow feeder outer casing that forms the outer wall 152, carbon steel or stainless steel carbon steel or stainless steel for the mass flow feeder inner wall 154, carbon steel or stainless steel for the mass flow feeder weir 160. Prospectively, seals constructed from buna nitrile will be used to ensure minimal liquid leakage near the rotation member. Prospectively, the auger 188 will be conventional and will be sized to accommodate 60 cubic meters per hour.

Yoshikawa (U.S. Pat. No. 6,860,410; "Yoshikawa") discloses a circle feeder for powders and grains. A related company manufactures circle feeders that, prospectively, are adaptable for use in the methods and systems described herein.

All patents and published patent applications referenced herein are incorporated herein by reference for all purposes.

With respect to the above description then, it is to be realized that the optimum apparatus and methods for a particular drilling operation will include dimensional adjustments and accommodative structure which will occur to those skilled in the art upon review of the present disclosure.

All equivalent relationships to those illustrated in the drawings and described in the specification are intended to be encompassed by the present invention.

The descriptions and explanations of terms in this specification are for purposes of illustration only and are not to be construed in a limiting sense.

What is claimed is:

1. In a subterranean drilling operation of the type where earthen cuttings are produced, wherein at least a portion of the discharged cuttings received into a transportation device are wet, the method further comprising:

a) receiving the wet cuttings into a tank, the tank being positioned above a feeder, the feeder having an outer wall and an inner wall, a substantially flat floor having a first floor portion extending outwardly, a powered rotation member extending through the first floor portion, central sweep members, peripheral sweep members, a weir, and a substantially flat second floor portion positioned about the first floor portion and extending to the outer wall, the second floor portion having a discharge port, the tank being configured such that wet cuttings received within the tank substantially cover the first floor portion, the accumulated wet cuttings forming a primary column above the first floor portion;

b) sweeping the first floor portion with the central sweep members, the central sweep members being affixed to the powered rotation member, the powered rotation member positioning the central sweep members proximate the first floor portion, the rotation of the central sweep members displacing wet cuttings toward and beyond the perimeter of the first floor portion onto the second floor portion;

c) regulating the amount of wet cuttings being displaced from the first floor portion onto the second floor portion by alternatively lowering and raising the weir, the weir and the inner wall cooperating such that the lowered weir and the inner wall restrain sufficient wet cuttings above the first floor portion for formation of the primary column;

d) sweeping the second floor portion with the peripheral sweep members, the peripheral sweep members being rotated by the powered rotation member and positioned proximate the second floor portion such that the peripheral sweep members displace wet cuttings along the second floor portion;

e) discharging wet cuttings through the discharge port as the wet cuttings are displaced along the second floor portion; and f) receiving the discharged wet cuttings into the transportation device for transport away from the feeder, the receipt of wet cuttings being alternately terminated and started;

g) receiving the transported wet cuttings in a first additional temporary storage;

h) metering the wet cuttings discharged from the first additional temporary storage;

i) routing the metered wet cuttings to a drying process wherein the wet cuttings are at least partially dried;

j) routing at least part of the at least partially dried cuttings to a second additional temporary storage;

k) routing at least part of the at least partially dried cuttings from the drying process to storage on a floating vessel;

l) metering the at least partially dry cuttings discharged from the second additional temporary storage;

m) blending wet cuttings discharged from the first additional temporary storage with the at least partially dried cuttings discharged from the second additional temporary storage;

n) discharging the at least partially dried cuttings for overboard disposal; and o) routing the blend to the drying process.

2. In a subterranean drilling operation of the type where earthen cuttings are produced, wherein at least a portion of the discharged cuttings received into a transportation device are wet, the method further comprising:

a) receiving the wet cuttings into a tank, the tank being positioned above a feeder, the feeder having an outer wall and an inner wall, a substantially flat floor having a first floor portion extending outwardly, a powered rotation member extending through the first floor portion, central sweep members, peripheral sweep members, a weir, and a substantially flat second floor portion positioned about the first floor portion and extending to the outer wall, the second floor portion having a discharge port, the tank being configured such that wet cuttings received within the tank substantially cover the first floor portion, the accumulated wet cuttings forming a primary column above the first floor portion;

b) sweeping the first floor portion with the central sweep members, the central sweep members being affixed to the powered rotation member, the powered rotation member positioning the central sweep members proximate the first floor portion, the rotation of the central sweep members displacing wet cuttings toward and beyond the perimeter of the first floor portion onto the second floor portion;

c) regulating the amount of wet cuttings being displaced from the first floor portion onto the second floor portion by alternatively lowering and raising the weir, the weir and the inner wall cooperating such that the lowered weir and the inner wall restrain sufficient wet cuttings above the first floor portion for formation of the primary column;

d) sweeping the second floor portion with the peripheral sweep members, the peripheral sweep members being rotated by the powered rotation member and positioned proximate the second floor portion such that the peripheral sweep members displace wet cuttings along the second floor portion;

e) discharging wet cuttings through the discharge port as the wet cuttings are displaced along the second floor portion; and f) receiving the discharged wet cuttings into the transportation device for transport away from the feeder, the receipt of wet cuttings being alternately terminated and started; and g) receiving the transported cuttings on a floating vessel;

h) transporting the wet cuttings from the floating vessel using the transportation device to a second additional temporary storage;

i) metering the discharged wet cuttings from the first additional temporary storage;

j) routing the metered wet cuttings to a drying process wherein the wet cuttings are at least partially dried;

k) routing at least part of the at least partially dried cuttings to the second additional temporary storage;

l) routing at least part of the at least partially dried cuttings from the drying process to onshore disposal;

m) metering the discharged at least partially dry cuttings from the second additional temporary storage;

n) blending wet cuttings discharged from the first additional temporary storage with the at least partially dried cuttings discharged from the second additional temporary storage;

o) discharging the at least partially dried cuttings for onshore disposal; and p) routing the blend to the drying process.

* * * * *